US011117139B2

(12) United States Patent
Archetti et al.

(10) Patent No.: US 11,117,139 B2
(45) Date of Patent: Sep. 14, 2021

(54) GAS DEDUSTING FILTER APPARATUS AND PROCESS

(71) Applicant: ECOSPRAY TECHNOLOGIES S.R.L., Voghera (IT)

(72) Inventors: Maurizio Archetti, Terre di Pedemonte-Verscio (CH); Luca Muratori, Pontecurone (IT)

(73) Assignee: ECOSPRAY TECHNOLOGIES S.R.L., Boghera (IT)

( * ) Notice: Subject to any disclaimer, the term of this patent is extended or adjusted under 35 U.S.C. 154(b) by 502 days.

(21) Appl. No.: 16/076,636

(22) PCT Filed: Mar. 2, 2017

(86) PCT No.: PCT/IB2017/051220
§ 371 (c)(1),
(2) Date: Aug. 8, 2018

(87) PCT Pub. No.: WO2017/149489
PCT Pub. Date: Sep. 8, 2017

(65) Prior Publication Data

US 2019/0060912 A1 Feb. 28, 2019

(30) Foreign Application Priority Data

Mar. 2, 2016 (IT) ..... 102016000022036

(51) Int. Cl.
*B03C 3/155* (2006.01)
*B03C 3/019* (2006.01)
(Continued)

(52) U.S. Cl.
CPC ..... *B03C 3/155* (2013.01); *B03C 3/019* (2013.01); *B03C 3/366* (2013.01); *B03C 3/368* (2013.01); *B03C 3/80* (2013.01)

(58) Field of Classification Search
CPC combination set(s) only.
See application file for complete search history.

(56) References Cited

U.S. PATENT DOCUMENTS 1,957,560 A * 5/1934 Thompson ..... B03C 3/80 96/25
3,555,818 A * 1/1971 Vlier ..... B03C 3/41 96/64
(Continued)

FOREIGN PATENT DOCUMENTS

DE 2031704 * 12/1971 ..... B03C 3/41
DE 19613720 A1 * 10/1997 ..... B03C 3/08
(Continued)

OTHER PUBLICATIONS

PCT International Search Report and Written Opinion for corresponding PCT/IB2017/051220, dated Jun. 6, 2017.

*Primary Examiner* — Christopher P Jones
*Assistant Examiner* — Sonji Turner
(74) *Attorney, Agent, or Firm* — Troutman Pepper Hamilton Sanders LLR (Rochester)

(57) ABSTRACT

The present invention relates to a filter apparatus (1) for dedusting gas comprising one or more electrostatic precipitators (100), in each of said electrostatic precipitators (100) there being inserted at least one filtering unit (300) comprising, in turn, a plurality of filtering cells (301), e.g. of the wall flow type. The present invention also relates to a dedusting process for treating industrial gas. In particular, the dedusting process according to the present invention implemented by the filter apparatus having improved dusting efficiency, which is the object of the present invention, allows the treatment of gas coming from industrial processes, such as coal boilers, cement works, incinerators and like.

16 Claims, 5 Drawing Sheets

(51) Int. Cl.
*B03C 3/36* (2006.01)
*B03C 3/80* (2006.01)

(56) References Cited

U.S. PATENT DOCUMENTS

| | | | | | |
|---|---|---|---|---|---|
| 4,147,522 | A * | 4/1979 | Gonas | B03C 3/155 | 95/68 |
| 4,861,356 | A * | 8/1989 | Penney | B03C 3/12 | 96/77 |
| 4,940,471 | A * | 7/1990 | Penney | B03C 3/12 | 55/294 |
| 5,158,580 | A * | 10/1992 | Chang | B03C 3/019 | 55/341.1 |
| 5,334,238 | A * | 8/1994 | Goodson | B03C 3/80 | 95/59 |
| 5,616,171 | A * | 4/1997 | Barris | F01N 9/002 | 95/280 |
| 2015/0143994 | A1* | 5/2015 | Archetti | F01N 3/0234 | 95/280 |
| 2016/0144380 | A1* | 5/2016 | Kim | B03C 3/88 | 96/33 |

FOREIGN PATENT DOCUMENTS

| | | | | |
|---|---|---|---|---|
| ES | 2226566 | * | 3/2005 | B03C 3/80 |
| KR | 101577340 | B1 | 12/2015 | |
| WO | 2011/141827 | A1 | 11/2011 | |
| WO | 2013/179266 | A1 | 12/2013 | |

* cited by examiner

GAS DEDUSTING FILTER APPARATUS AND PROCESS

This application is a national stage application under 35 U.S.C. § 371 of PCT Application No. PCT/IB2017/051220, filed Mar. 2, 2017, which claims priority of Italy Application No. 102016000022036, filed Mar. 2, 2016, which are hereby incorporated by reference in their entirety.

FIELD OF THE INVENTION

The present invention relates to the dedusting of gas, e.g. coming from industrial processes and/or industrial systems, such as coal boilers, incinerators, cement works and the like. In particular, the present invention relates to a filter apparatus having improved dedusting efficiency.

The filter apparatus according to the present invention makes it possible to improve the dedusting efficiency of traditional electrostatic filters.

In particular, the filter apparatus according to the present invention makes it possible to obtain filtering efficiencies either equal to or better than those of bag filters or ceramic candle filters with much smaller overall size and, consequently, lower installation costs.

Last but not least, the apparatus according to the present invention requires fewer maintenance operations than traditional bag filters or ceramic candle filters, which translates into a further cost abatement.

The present invention further relates to a dedusting process implemented by means of said filter apparatus.

The dedusting process according to the present invention makes it possible to obtain filtering efficiencies either equal to or higher than those of bag filters or ceramic candle filters.

SCOPE OF THE INVENTION

Electrostatic separators or precipitators are also known in the gas dedusting sector, in particular for treating gas coming from industrial processes and/or industrial systems, such as coal boilers, incinerators, cement works and the like.

Electrostatic precipitators make it possible to separate the solid polluting particles from the input gas flow.

Indeed, electrostatic precipitators, by means of a difference of potential induced between the emitting and collecting electrodes, achieve the separation of the contaminated particles from the carrier gas which is made to flow between the electrodes. An air flow free from contaminating particles is thus obtained in output.

The dust removal efficiencies of such electrostatic separators or electro-precipitators often do not allow them to achieve the limits required by the most stringent standards in the sector, particularly if the gases to be treated are at high temperatures.

DESCRIPTION OF THE PRIOR ART

The particulate material, in general, consists of ashes and/or dust dragged by the gas flow.

The systems mainly used for capturing particulate consist of:

- Electrostatic filters (electrostatic precipitators) for low and high temperature;
- Bag filters for low temperature applications (lower than 250° C.);
- Ceramic candle filters for high temperature applications (higher than 250° C.).

Electrostatic filters are generally considered relatively high efficiency systems for abating fume particulate (abatement based on inducing electrostatic charges on the fume dust and capturing the dust on a deposit electrode). However, the result is heavily conditioned by the resistivity of the dust, i.e. by the capacity to assume the electrostatic charges induced by the ionizing electrode.

With very low resistivities ($10^3$, $10^5$ ohm×cm), the particles can easily lose the charge that took them to the capturing electrode and return into the gaseous flow once the cohesion force is overcome.

Problems also occur with particles having excessively high resistivity $10^{10}$ ohm×cm) for their difficulty to neutralize a charge once in contact with the capturing electrode. In such case, an excessive accumulation, which makes filter cleaning operations, in particular of the electrodes, necessary is determined. The periodical cleaning of the electrodes is in all cases needed also in presence of regular operation. The cleaning operations are performed with mechanical percussions. Electrostatic precipitators have good efficiencies also for submicronic particles, low operating costs and relatively simple management.

In bag filters or ceramic candle filters, the dust is separated from the fumes by means of a proper filtering effect, obtained by making the gaseous current cross through fabric bags (tubular, 150 mm in diameter, 6000-8000 mm long) consisting of microporous felts. The filtering effect is provided, firstly, by the small size of the pores of the felt which allows the passage of the gas but not of the dusty particles; the effect determined by the dust layer depositing on the bags becomes gradually more important as the operation proceeds. Indeed, when such layer (of accumulation) has reached a thickness such to cause losses of load deemed excessive on the gas path, the bags themselves must be cleaned, e.g. by means of counterflow compressed air jets.

The materials used in the bag filters (Teflon or Teflon-coated materials) do not allow temperature values higher than the range comprised between about 150° C. and 220° C. The materials used in ceramic candle filters are sintered ceramic fibers or porous ceramic structures.

The operating principle is very simple: in a bag filter cleaned with compressed air, a steel basket prevents the bag from "collapsing" during the normal filtering, while in ceramic candle filters the structure is rigid and maintains its shape.

When the fumes pass from the outside through the filtering means, the dust forms a deposit on the surface of the bag or on the ceramic candle. The filtering means are generally cleaned by a compressed air pulse in each bag or in each ceramic candle sent by a nozzle installed immediately over the bag or the ceramic candle.

These brief air pulses exit from the nozzles and cross the filtering bags of the candles. The dust layer is thus destroyed by the shock wave and falls into the hoppers.

The dust is then removed from the hoppers by means of an evacuation system for successive extraction or reuse.

The electrostatic filters have good filtering efficiencies but are not sufficient to comply with the most stringent standards on particulate emissions. It is thus necessary to define methods which may increase the efficiency of existing electrostatic filters in order to reduce the emissions thereof under the limits prescribed by the most modern standards.

Currently, there are various methods.

A currently known apparatus envisages the installation of a plurality of filtering bags in the end part of an electrostatic precipitator. In all cases, this known system is not free from drawbacks. A first drawback is in that the installation of the filtering bags requires considerable changes to the electrostatic precipitator, with consequent increase of the installation costs due mainly to the high volumes required by the filtering bags. The space for the bags is not sufficient to keep its loss of load down and its reliability acceptable for a long time.

Another method consists in transforming the electrostatic precipitator into a bag filter. In this manner, the greatest drawback is the high cost for supply and assembly. Another drawback is in that the bag filter cannot work in optimal manner at high temperatures, because the material of which the filtering bags are made has a working limit lower than 250° C.

Another method is to enlarge the electrostatic filter so as to increase efficiency.

Also in this case, the drawback is that of having high costs for modification, dismantling, assembly and insulation.

SUMMARY OF THE INVENTION

The present invention thus aims to solve these issues by suggesting a filter apparatus comprising a very compact filtering unit, such to be installed in the outlet hood of an existing electrostatic filter so as to reduce the dustiness in the output flow to extremely low levels, lower than those of an existing bag filter or ceramic candle filter, while keeping the existing electrostatic filter in operation.

According to the present invention, a filter apparatus is suggested comprising an electrostatic filter and at least one filtering unit provided with regeneration means according to the present invention, as well as a filtering process implemented by such apparatus.

According to a consideration underling the present invention, as the gas flow was already dedusted by the electrostatic filter to concentrations lower than 100 mg/Nm3, the suggested filtering unit must have a filtering efficiency in the order of 90-99%, which is typical of the efficiency of the wall flow filtering elements described above. In this manner, the gas flow may be taken downstream of said filter apparatus to dustiness levels of 2-3 mg/Nm3 by virtue of the combined action of the electrostatic filter (which works as primary deduster) and of the filter apparatus, which works as finisher.

It is thus an object of the present invention to suggest and/or make available a filter apparatus which combines an electrostatic precipitator and a filtering wall including filtering cells, e.g. of the wall flow type, with a very high overall filtering efficiency, very low installation costs with respect to the conversion of an electrostatic filter into a bag filter or a ceramic candle filter. The low installation costs mainly derive from the high compactness of the filtering unit which is the object of the present invention and consequently of the filter apparatus which is the object of the invention. The filtering unit implies short assembly times and minimum changes to the structures of the electrostatic precipitator in case of retrofitting of existing electrostatic filters.

It is a further object of the present invention to provide a filter apparatus having improved dedusting efficiency which displays an improved reliability with respect to the filtering systems of known type, with consequent reduction of the supplementary maintenance costs. This is possible because the filtering boxes, e.g. of the wall flow, may be made of material which is mechanical and chemically strong (e.g. silicon carbide). Last but not least, it is an object of the present invention to provide a filter apparatus having improved dedusting efficiency, capable of operating at high temperatures, i.e. in the order of 600° C., condition of use which cannot be achieved by the bag filters of known type.

It is a further object of the present invention to provide a filter apparatus having improved dedusting efficiency which comprises a system for uniforming the gas flow in the electrostatic precipitator itself, regardless of the presence of the perforated plate which is present in the outlet hood of the electrostatic precipitators of known type.

Last but not least, it is the object of the present invention also to provide a dedusting process for treating industrial gas. In particular, the dedusting process according to the present invention implemented by the filter apparatus having improved dusting efficiency which is also the object of the present invention allows the treatment of gas coming from industrial processes, such as coal boilers, cement works, incinerators and like.

This task and other objects which will be more apparent hereinafter from the detailed description of a preferred embodiment of the present invention are achieved by a filter apparatus for gas dedusting which comprises one or more electrostatic precipitators, at least one filtering unit comprising, in turn, a plurality of filtering cells of the wall flow type being inserted in each of said electrostatic precipitators.

Preferably, the filtering unit is placed in the outlet hood of the precipitator itself and is configured as a wall so as to form a layer of filtering cells, e.g. of the wall flow type, arranged in parallel.

The wall flow filtering elements are currently used as particulate traps in motor vehicles by virtue of their compactness. They consist of elements containing a high number of small channels crossed by the dusty gas. Since each channel is closed on the bottom, the gas must permeate through the porous side wall of the channel passing in the near channel and then exiting downstream. The filtering and dedusting is thus achieved with very compact dimensions. The volume of a wall flow element is about twenty times smaller than that occupied by bag filters or ceramic candle filters the filtering surface being equal.

For their geometry and compactness, the wall flow elements are currently used only in the automotive sector as particulate traps. However, they are not adapted to operate with high particulate loads or large-size dust, such as those typical of industrial systems, such as cement works and coal electric power stations.

Furthermore, the filtering ceramic wall of the channels themselves is very thin and therefore does not normally guarantee filtering efficiencies higher than 98-99% for fine particles.

The wall flow elements used in the automotive sector are therefore not intrinsically adapted to operate with high loads of particulate and large-size dimensions.

BRIEF DESCRIPTION OF THE FIGURES

The present invention will be explained in greater detail below by means of a detailed description of the embodiments shown in the drawings, wherein, in all cases, the present invention is not limited to the embodiments described above and shown on the drawings.

In the accompanying drawings.

DETAILED DESCRIPTION OF THE INVENTION

Figure 1:
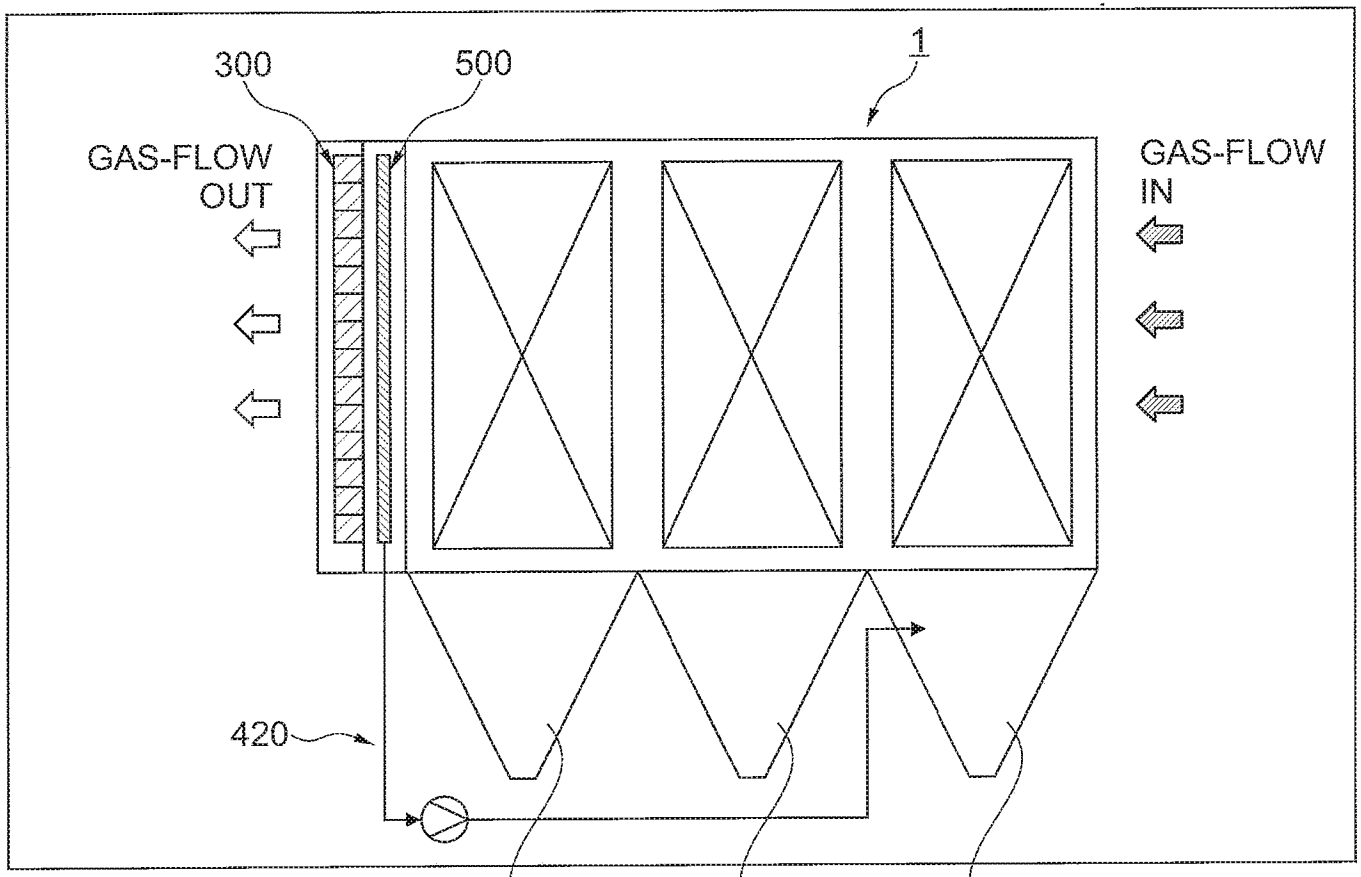
FIG. 1 shows a diagrammatic side view of the filter apparatus according to an embodiment of the present invention.

The filter apparatus 1 according to the embodiment of the present invention shown in FIG. 1 comprises at least one electrostatic separator or precipitator 100 provided, in turn, with at least one inlet 101 for the gas to be subjected to filtering and at least one outlet 102 for the treated gas.

It is thus possible to identify a gas flow advancement direction in the electrostatic precipitator 100, such advancement direction being indicated in the accompanying figures by the direction of the "IN" arrow at the inlet of the electrostatic precipitator 100 and of the "OUT" arrow at the outlet of the electrostatic precipitator 100.

With respect to such gas advancement direction in the precipitator, said gas inlet 101 in the electrostatic precipitator 100 is arranged upstream of the electrostatic precipitator 100, while said outlet section 102 is arranged downstream of the electrostatic precipitator 100.

Figure 3:
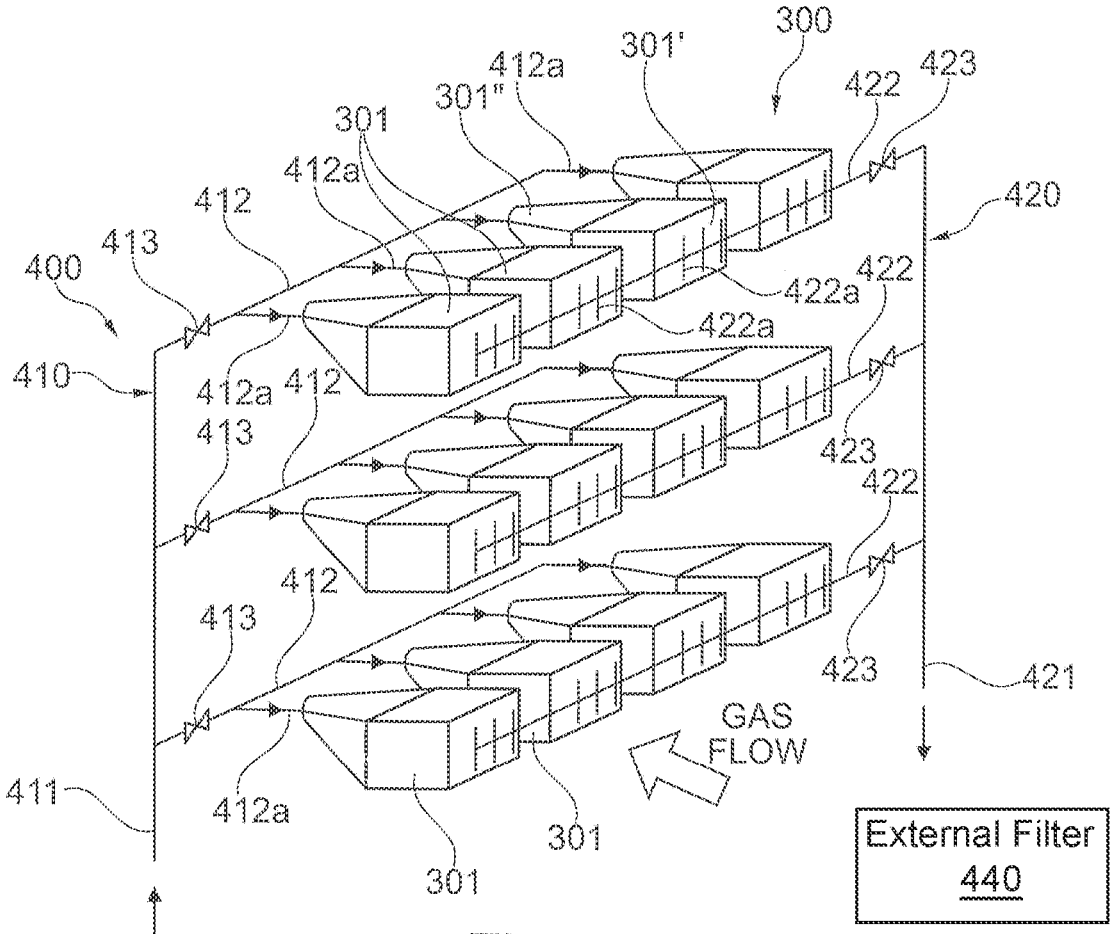
FIG. 3 shows a diagrammatic view of an embodiment of the wall flow filtering cell filtering unit comprising a pneumatic regeneration circuit.

With particular reference to FIG. 3, the filter apparatus 1 according to the present invention further comprises a plurality of filtering cells, for example but not exclusively of the wall flow type 301, arranged in a matrix and therefore in rows and columns, so as to form a wall-shaped filtering unit 300 positioned in the electrostatic precipitator 100 so as to be invested by the gas to be treated. In particular, according to an embodiment, the inlet portion 101 and/or the outlet or exhaust portion 102 of the electrostatic precipitator 100 are hood-shaped (e.g. with truncated-cone or truncated-pyramid section), the filtering unit being preferably positioned in the outlet hood of the electrostatic precipitator (100).

The filtering unit 300 with cells 301, e.g. of the wall flow type, according to the embodiment of the present invention shown in the drawings, comprises a regeneration system of the dust accumulated on the filtering surface itself of the cells 301.

The wall flow elements of known type used for example in the automotive sector do not comprise any regeneration system because in these applications the particulate is simply burnt since it consists of organic material (soot and drops of liquid hydrocarbons).

The structure of the wall flow type cells is however mechanically very strong and another advantage of such filtering system consists thus in that the filtering unit can operate at temperatures up to 700° C.

By virtue of the installation position downstream of the electrostatic precipitator 100 where the dust levels are low and there are no large-sized particles, and by virtue of the regeneration system according to the present invention, which in some examples uses compressed air, such wall flow filtering elements may be used to make an extremely compact filtering wall housed in the outlet hood of the electrostatic precipitator capable of filtering the entire flow of effluent gas in the electrostatic precipitator. Furthermore, dedusting efficiency higher than 99% is not needed in this application because the dust pre-separation was already performed by the electrostatic filter itself.

Considering the need (or at least the opportuneness) of periodically and automatically removing the accumulated dust, the filter apparatus according to the embodiment of the present invention is characterized in that it further comprises a counterflow compressed air pulse system of the filtering cells, such as those of said wall flow type.

Said filtering cells (301) are, as shown, arranged side-by-side so as to form a filtering wall arranged upstream of the outlet section of the electrostatic precipitator.

Figure 2:
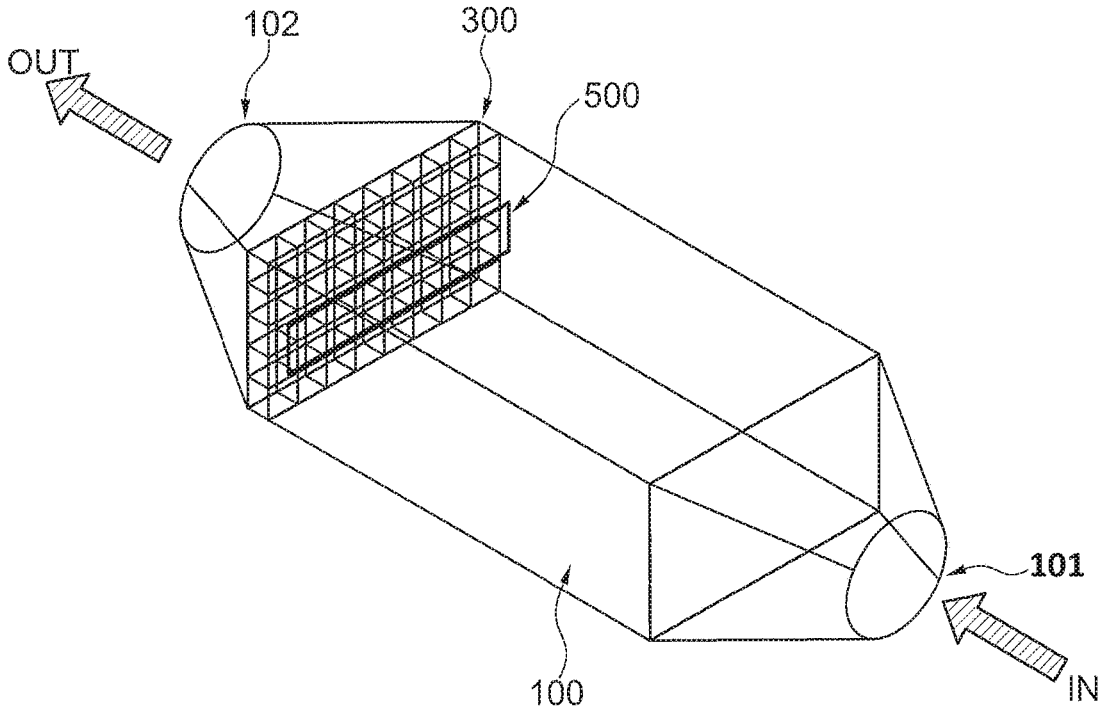
FIG. 2 shows a diagrammatic perspective view of the filter apparatus according to an embodiment of the present invention in which the counterflow compressed air pulse washing system used for regenerating the filtering unit is not shown.

A front inlet surface 301' of the gas to be treated and an rear outlet surface 301" of the outlet surface of the gas to be treated are found on each filtering cell 301, where the orientation of the cell, and thus the words "front" and "rear", are, as mentioned, referred to the gas flow direction to be treated which strikes the cell itself (FIGS. 1 and 2).

Preferably, said filtering wall 300 is placed inside said electrostatic precipitator 100, preferably immediately upstream of the outlet section 102 (and possibly in the hood-shaped portion). With particular reference to FIGS. 1 and 2, said filtering wall 300 is arranged substantially transversally to the advancement direction of the gas flow to be treated.

According to a first preferred embodiment of the present invention shown by way of non-limiting example in FIG. 3, the filter apparatus 1 according to the present invention further comprises a regeneration system 400 of the flow filtering cells 301 on the wall of said filtering wall 300.

Preferably, said regeneration system 400 comprises, in turn, a feeding line or circuit 410 to feed a fluid, preferably in gaseous state, preferably air, to said cells 301 of said filtering wall 300 in counterflow with respect to the direction with which the gas to be treated which crosses the apparatus strikes it during the gas treatment. So, assuming for the sake of simplicity, the use of a washing gas (see the description below), reference will be made hereinafter to a pneumatic line (or possibly a pneumatic circuit) 410.

Said feeding line or circuit 410 comprises, in turn, a first common stretch 411 of the feeding circuit which branches into a plurality of feeding conduits 412, each adapted to convey the fluid to a nozzle 412*a*, a dedicated nozzle 412*a* being preferably provided for each cell 301 of said filtering wall 300.

According to a preferred embodiment shown in FIG. 3, being said filtering cells 301 arranged mutually side-by-side to form said rows and/or columns (of a matrix), advantageously said common feeding line 411 branches into a plurality of feeding conduits 412, each feeding conduit 412 being configured to convey the washing fluid to a row of cells 300*a*.

Naturally, a different configuration of the regeneration circuit may comprise feeding conduits which convey the washing fluid to cells arranged in columns, instead of in rows, as shown here, such variants being comprised in the scope of protection of the present invention in all cases.

Turning back to the embodiment shown in FIG. 3, said regeneration system 400 further comprises collecting means 420 (of the washing fluid escaping in counterflow from the cells 301), including, in the embodiment shown in the figure, a collection and conveying 421 line (for example, a pneumatic line) configured to convey the washing fluid (loaded with the dust removed from the cells 301) after the counterflow washing thereof. In the scope of this invention, pneumatic line (and/or pipe) means a line and/or pipe adapted to convey a gaseous fluid.

At each of said filtering cells 301, in particular at the front surface 301' of said of said filtering cells 301, said washing fluid and dust collecting means 420 comprise dedicated collecting means 422*a*.

In particular, said collection line 421 branches, in turn, similarly to that seen for the feeding line 411, into a plurality of collection ducts 422, one collection duct for each row of cells, e.g. connected, in turn, to said dust collecting means 422*a* arranged at each single cell.

Advantageously, a shut-off valve 413 is envisaged on the supply line 410, and in particular on each single feeding conduit 412 upstream of said nozzles 412*a*.

In this manner, it is possible to advantageously proceed with selective regeneration (selective washing) of a group of cells 301, e.g. of a row 300*a* or of two or more rows 300*a*, without involving all the cells of the filtering wall 300 in the washing process. In this manner, the filter apparatus can continue its gas dedusting operation without the filtering wall cell regeneration operations invalidating the filter functionality.

Similarly to that shown on the feeding line 410, also for the collecting means 420, in particular on the washing fluid and dust collection line 421, shut-off valves 423 for collecting the washing fluid and dust escaping from the cells 301 are envisaged so as to proceed with the selective washing of one or more groups of cells in this manner, as mentioned.

Turning back to the overview in FIG. 3, said regeneration system 400 preferably comprises, as mentioned, said at least one pneumatic collection line 421 of the washing liquid (dust load) which escapes from the cells 301 following the washing with pressurized gas, preferable counterflow compressed air pulses, as mentioned.

With reference to FIG. 1, said regeneration system, and in particular the dust collecting means 422*a* arranged at the front inlet surface 301' of the gas to be treated in each single cell, preferably form a dust-catching grid, generically indicated in FIGS. 1 and 2 by reference number 500, which is arranged upstream of said filtering wall 300, with respect to the flow direction of the gas to be treated. For example, said grid 500 may comprise perforated tubular stretches each arranged at a cell 301.

Again with reference to FIG. 1, said regeneration system may advantageously comprise the dust-catching pneumatic line 421 connected to said dust-catching grid, as shown above, for carrying the dust, configured to convey the dust extracted from the cells 301.

According to a possible embodiment, shown in FIG. 1, said collection line 421 may advantageously convey the dust directly into one of the collection hoppers 600 provided under said electrostatic precipitator 100.

According to an alternative embodiment of the present invention, not shown in the accompanying figures, the collecting means 420, in particular by means of the collection line 421, may advantageously convey the dust to a dedicated filter, external to the electrostatic precipitator 100 to which they are connected (e.g. by means of line 421, if present) in fluid connection.

According to a further alternative embodiment of the present invention, not shown in the accompanying figures, said collecting means 420 may advantageously convey the dust upstream of the electrostatic precipitator 100 itself, or in any point of the electrostatic precipitator, thus achieving in fact a recycling line, on said recirculation line.

According to a preferred embodiment of the present invention, said dust-catching grid 500 comprises intake means, preferably comprising a circular or rectangular section tube, provided with suction holes.

Said suction means of said grid 500 comprise one or more fans, the intake flange of which is connected to the dust-catching grid, generates a vacuum capable of preferably conveying the dust into the collection grid, thus moving it away from the filtering wall 300.

Figure 4:
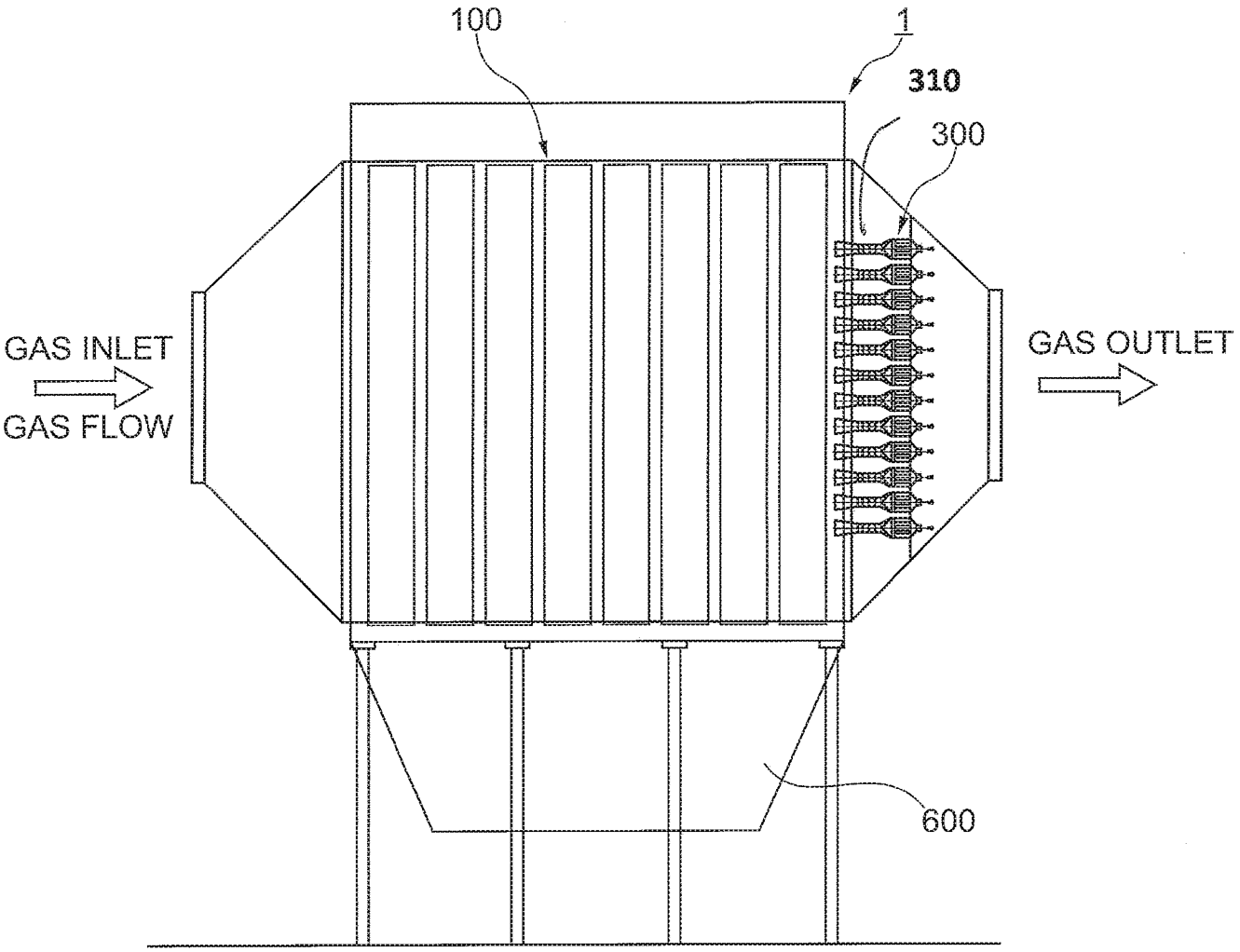
FIG. 4 shows a diagrammatic overview of the filter apparatus according to an embodiment of the present invention, in which a Venturi tube is associated with the filtering cells of the filtering unit.
Figure 5:
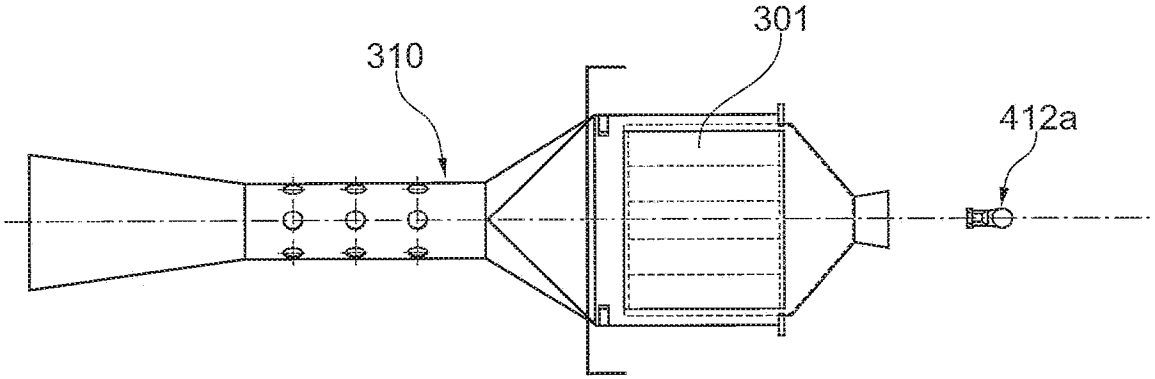
FIG. 5 shows in detail a filtering cell according to an embodiment of the present invention, the cell being provided with a Venturi tube.

According to a further embodiment of the present invention, shown in the FIGS. 4 and 5, a Venturi tube 310 is arranged upstream of each of said filtering cells 301 and directly connected thereto. The reference is in particular to FIG. 5.

According to this embodiment, the washing fluid and dust collecting means 420 including the dust collection line 421, and possibly the grid 500 and the suction means, and/or of the recirculation circuit to a point of the electrostatic precipitator could be possibly omitted. Indeed, by virtue of the Venturi tubes 310, the compressed air emitted by the nozzles 412*a* crosses the cell 301 and escaping from the cell, loaded with dust, is expanded and accelerated in the Venturi tube, which thus impresses a speed to the compressed air flow sufficient to reach a zone of the electrostatic precipitator sufficiently upstream, and thus near the inlet zone 101, to be filtered again by the precipitator and fall into the collection hoppers 600.

According to the present invention, an embodiment is provided in which the washing fluid and dust collecting means 420 including the dust collection line 421, and possibly the grid 500 and the suction means, and/or the dust recirculation circuit to a point of the electrostatic precipitator are provided and positioned and/or arranged so as to collect (intercept and/or capture) the washing fluid (loaded with dust) escaping from the Venturi tubes 310.

It is further object of the invention a dedusting process comprising the following steps:

- a first step of filtering by means of an electrostatic precipitator 100;
- a second step of filtering by means of said filtering unit 300 comprising said plurality of wall flow filtering cells 301.

According to an embodiment, the dedusting process further comprises a step of regenerating of said filtering unit 300.

Said step of regenerating preferably comprises at least one step of washing of said wall flow cells 301 by means of counterflow compressed air pulses. The dedusting process according to an embodiment of the present invention preferably comprises a further step of collecting and/or conveying the dust escaping from said filtering cells 301 following the counterflow washing to an external filter 440.

Alternatively, the dedusting process according to an embodiment of the present invention preferably comprises a step of recirculating the dust escaping from said filtering cells 301 after the counterflow washing in any point of the electrostatic precipitator 100, e.g. by means of a pneumatic collecting and conveying line 421.

Alternatively, the dedusting process according to the present invention preferably comprises a step of accelerating of the washing fluid and of the dust escaping from the cells 301, e.g. by means of Venturi tubes 310, and possibly a step consisting in sending the dust escaping from said Venturi tubes 310 into the electrostatic precipitator.

The filter apparatus thus devised and described, like the dedusting process which is the object of the present invention, thus achieve the set task and objects.

Many changes can be made by a person skilled in the art without departing from the scope of protection of the present invention, determined by the scope of the claims, which are an integral part of the present text and are thus entirely quoted herein.

The scope of protection of the claims, therefore, must not be limited to the illustration or preferred embodiments described by way of example, but rather the claims must include all the features of patentable novelty inferable from the present invention, including all the features that would be treated as equivalent by a person skilled in the art.

The invention claimed is:

1. A filter apparatus for dedusting gas coming from industrial processes or plants comprising:

an electrostatic precipitator; and a filtering unit housed in the electrostatic precipitator, the filtering unit comprising a plurality of filtering cells arranged to form a filtering wall adapted to be struck by a flow of gas inside the electrostatic precipitator, the filtering unit comprising:

a regeneration system for the plurality of filtering cells, the regeneration system comprising:

a device for conveying or delivering a washing fluid to the plurality of filtering cells in counterflow with respect to the flow of the gas in the electrostatic precipitator; and a collecting or conveying device for collecting or conveying washing fluid escaping from the plurality of filtering cells following washing by the washing fluid, wherein the collecting or conveying device comprises a plurality of Venturi tubes positioned upstream from a corresponding one of the plurality of filtering cells with respect to the flow of the gas in the electrostatic precipitator and configured to increase speed of the washing fluid escaping from the corresponding one of the plurality of filtering cells.

2. The filter apparatus according to the claim 1, wherein the collecting or conveying device comprises a pneumatic collection line for collecting the dust that escapes from the plurality of Venturi tubes following washing of the plurality of filtering cells by the washing fluid.

3. The filter apparatus according to the claim 2, wherein the collecting or conveying device comprises a collecting grid.

4. The filter apparatus according to the claim 3, wherein the collecting grid comprises a plurality of tubular components, each of the plurality of tubular components comprising suction holes and being positioned either at a corresponding one of the plurality of Venturi tubes or directly at the corresponding one of the plurality of filtering cells.

5. The filter apparatus according to claim 3, wherein the collecting or conveying device comprises a suction device adapted to generate a vacuum adapted to convey the dust into the collecting grid upstream of the filtering unit.

6. The filter apparatus according to claim 2, wherein the pneumatic collection line is in fluid connection with an external filter, the external filter located external to the electrostatic precipitator.

7. The filter apparatus according to claim 2, wherein the pneumatic collection line is configured to recirculate the dust upstream of the electrostatic precipitator or in any point of the electrostatic precipitator upstream of the filtering unit.

8. The filter apparatus according to claim 1, wherein each of the plurality of filtering cells is configured as a wall flow filtering element.

9. The filter apparatus according to claim 1, wherein the device for conveying the washing fluid to the plurality of filtering cells in counterflow with respect to the flow of the gas in the electrostatic precipitator comprises a pneumatic supply line for feeding the washing fluid under pressure, to the plurality of filtering cells.

10. The filter apparatus according to claim 9, wherein the pneumatic supply line comprises a first supply line portion that branches into a plurality of supply pipes, each of the plurality of supply pipes having a nozzle positioned to convey the washing fluid to one of the plurality of filtering cells.

11. The filter apparatus according claim 1, wherein an exhaust portion of the electrostatic precipitator for exhausting the gas is hood-shaped, the filtering unit being installed in the exhaust portion of the electrostatic precipitator.

12. A gas dedusting process comprising:

providing a filtering apparatus comprising:

an electrostatic precipitator; and a filtering unit housed in the electrostatic precipitator, the filtering unit comprising a plurality of filtering cells arranged to form a filtering wall adapted to be struck by a flow of gas inside the electrostatic precipitator, the filtering unit comprising:

a regeneration system for the plurality of filtering cells, the regeneration system comprising:

a device for conveying or delivering a washing fluid to the plurality of filtering cells in counterflow with respect to the flow of the gas in the electrostatic precipitator; and a collecting or conveying device for collecting or conveying washing fluid escaping from the plurality of filtering cells following washing by the washing fluid, wherein the collecting or conveying device comprises a plurality of Venturi tubes positioned upstream from a corresponding one of the plurality of filtering cells with respect to the flow of the gas in the electrostatic precipitator and configured to increase speed of the washing fluid escaping from the corresponding one of the plurality of filtering cells;

electrostatic filtering the gas by the electrostatic precipitator;

filtering the gas by the filtering wall comprising the plurality of filtering cells;

regenerating the plurality of filtering cells of the filtering unit by sending a washing fluid to the plurality of filtering cells in counterflow with respect to the flow of the gas in the electrostatic precipitator, and collecting or conveying the washing fluid escaping from the plurality of filtering cells following washing by the washing fluid.

13. The dedusting process according to claim 12, wherein the washing fluid comprises pulsed compressed air.

14. The dedusting process according to claim 12, further comprising collecting the washing fluid escaping from the plurality of filtering cells.

15. The dedusting process according to claim 14, further comprising conveying the washing fluid flow escaping from the plurality of filtering cells to a dedicated filter external to the electrostatic precipitator.

16. The dedusting process according to claim 14, comprising reintroducing the washing fluid escaping from the plurality of filtering cells in any point of the electrostatic precipitator upstream of the filtering unit.

* * * * *